US011002102B2

(12) United States Patent
Sevheim et al.

(10) Patent No.: US 11,002,102 B2
(45) Date of Patent: May 11, 2021

(54) PLUG AND PRODUCTION TUBING FOR A PETROLEUM WELL

(71) Applicant: PETROLEUM TECHNOLOGY COMPANY AS, Stavanger (NO)

(72) Inventors: Ole Sevheim, Stavanger (NO); Erling Kleppa, Jørpeland (NO)

(73) Assignee: PETROLEUM TECHNOLOGY COMPANY AS, Stavanger (NO)

( * ) Notice: Subject to any disclaimer, the term of this patent is extended or adjusted under 35 U.S.C. 154(b) by 71 days.

(21) Appl. No.: 16/305,432

(22) PCT Filed: Jun. 1, 2017

(86) PCT No.: PCT/NO2017/050140
§ 371 (c)(1),
(2) Date: Nov. 29, 2018

(87) PCT Pub. No.: WO2017/209626
PCT Pub. Date: Dec. 7, 2017

(65) Prior Publication Data

US 2020/0123872 A1 Apr. 23, 2020

(30) Foreign Application Priority Data

Jun. 3, 2016 (NO) ..... 20160961

(51) Int. Cl.

| | |
|---|---|
| ***E21B 33/12*** | (2006.01) |
| ***E21B 33/124*** | (2006.01) |
| ***E21B 34/06*** | (2006.01) |
| *E21B 43/12* | (2006.01) |

(52) U.S. Cl.
CPC ..... *E21B 33/12* (2013.01); *E21B 33/124* (2013.01); *E21B 34/063* (2013.01); *E21B 43/123* (2013.01)

(58) Field of Classification Search
CPC .... E21B 33/12; E21B 33/1208; E21B 33/124; E21B 43/123
See application file for complete search history.

(56) References Cited

U.S. PATENT DOCUMENTS 2,601,614 A * 6/1952 Johnson ..... B08B 9/0553 15/104.061
4,359,094 A * 11/1982 Risinger ..... E21B 23/08 137/70
5,054,558 A 10/1991 Barneck
(Continued)

FOREIGN PATENT DOCUMENTS

WO 2014/118380 A2 8/2014
WO 2016/003890 A1 1/2016

OTHER PUBLICATIONS

PCT International Search Report; PCT/NO2017/050140; dated Sep. 22, 2017.
Norwegian Search Report; NO 20160961; dated Dec. 16, 2016.

*Primary Examiner* — Cathleen R Hutchins
(74) *Attorney, Agent, or Firm* — Bracewell LLP; Constance G. Rhebergen; Linda L. Morgan

(57) ABSTRACT

A downhole plug, has an elongate body, the body having a longitudinal axis; a first seal arranged on an outer surface of the elongate body; and a second seal arranged on the outer surface of the elongate body and spaced longitudinally from the first seal. A production tubing for a petroleum well, includes a pipe, at least one side pocket mandrel, and at least one plug.

10 Claims, 4 Drawing Sheets

(56) References Cited

U.S. PATENT DOCUMENTS

| | | | | |
|---|---|---|---|---|
| 6,932,581 | B2 | 8/2005 | Messick | |
| 7,845,401 | B2 * | 12/2010 | Wildman | E21B 33/16 166/177.3 |
| 2010/0084139 | A1 | 4/2010 | Moreno | |
| 2010/0122819 | A1 | 5/2010 | Wildman et al. | |

* cited by examiner

PLUG AND PRODUCTION TUBING FOR A PETROLEUM WELL

The present invention relates to plugs for use in a wellbore, for example to such plugs suitable for use with side pocket mandrels in a production tubing during petroleum production.

BACKGROUND OF THE INVENTION

During downhole operations in petroleum production, there are in certain situations a need for communication between a production tubular and an outer annulus between the production tubular and the well casing. Two examples of such downhole operations are gas lift and chemical injection. During gas lift, injecting gas into the production pipe from the annulus assists the production, i.e. the well flow. Similarly, chemical injection can be used, wherein chemicals are injected into the production pipe.

Typically, a controlled amount of gas or chemicals can be injected by means of a control device, which can, for example, be integrated into a side pocket mandrel (SPM) in the production tubular. Such a control device will typically comprise one or more valves disposed in openings in the production pipe, thereby permitting a controlled fluid communication between the annulus and the inside of the production pipe. In some cases, a plurality of valves are provided in series to achieve a double (or multiple) barrier. Documents which may be useful for understanding the background include international patent applications WO 2014/118380 A2 and WO 2016/003890 A1, and US patent document U.S. Pat. No. 6,932,581 B2, U.S. Pat. No. 5,054,558 and US 2010/0122819 A1.

A well goes through several phases during its lifetime. Production rates will usually decline as the well gets more mature, because reservoir pressure drops. Various means can be employed to counteract such a decline in production, for example downhole pumps, gas lift or chemical treatment. There may also be a need for stimulation of the reservoir itself, e.g. through fracturing, chemical treatment, or similar.

When using gas lift valves arranged in SPMs in the production tubing, there may be a considerable period between completion of the well and start of production, and the time at which the pressure has dropped to a level where gas lift is required. This period may be several years. During this time there is no need to have idle valves installed in the SPM, and it may be disadvantageous since such valves may be subjected to clogging, erosion, or other negative effects. In such cases, complicated and laborious operations may be required to repair or replace the valves. Also for the purpose of various other well operations it may be an advantage not having SPM valves installed from the time of completion.

Rather than leaving operational valves installed, unused and idle, it is common to use so-called dummy plugs. These are, in principle, plugs which close the connection between the annulus and the production tubing. When required, the dummies can then be replaced with operational valves in a well intervention operation.

Since the installation of such dummies takes place downhole, it is important that these are easy to install and remove, with low risk of error. Moreover, such dummies may be installed and left in place for long periods of time, commonly several years, and may be subjected to very harsh conditions downhole. It is therefore of critical importance that these dummies are reliable and have low failure rates.

The present invention aims to address challenges and limitations with known technology and provide improved solutions and techniques in relation to such plugs.

SUMMARY OF THE INVENTION

In an embodiment, there is provided a downhole plug, having an elongate body, the body having a longitudinal axis;

a first seal arranged on an outer surface of the elongate body; and a second seal arranged on the outer surface of the elongate body and spaced longitudinally from the first seal, wherein the body comprises a first part and a second part, the first seal arranged on the first part and the second seal arranged on the second part, wherein the first part is coupled to the second part and movable in relation to the second part in the direction of the longitudinal axis.

In an embodiment, the first part and the second part has a surface, each surface having a normal vector, the normal vector having an angle in relation to the longitudinal axis which is different than 90 degrees, each surface arranged such that a pressure force acting on the surface urges the first part away from the second part.

In an embodiment, the first part is coupled to the second part by means of a telescopic connector.

In an embodiment, the telescopic connector comprises a pin fixed to the second part, the pin being slidably arranged in a receiver fixed to the first part.

In an embodiment, the pin comprises a surface having a normal vector, the normal vector having an angle in relation to the longitudinal axis which is different than 90 degrees, and the receiver comprises a port arranged to provide fluid communication between the outside of the plug and the surface.

In an embodiment, the first part forms a back section of the plug and the second part forms a front section of the plug.

In an embodiment, the first part and the second part have substantially circular cross sections, and the cross section of the second part is smaller than the cross section of the first part.

In an embodiment, there is provided a downhole plug, having an elongate body, the body having a longitudinal axis;

a first seal arranged on an outer surface of the elongate body;

a second seal arranged on the outer surface of the elongate body and spaced longitudinally from the first seal;

a fluid chamber arranged in the body; and a fluid port arranged on the outer surface of the elongate body between the first seal and the second seal.

In an embodiment, the plug further comprises a pressure control device arranged between the fluid port and the fluid chamber and configured to control the flow of fluid between the fluid port and the fluid chamber.

In an embodiment, the pressure control device is configured to open or break upon being subjected to a pressure exceeding a pre-determined threshold pressure.

In an embodiment, the pressure control device is a rupture disc, a piston, or a rupture pin.

In an embodiment, the pressure control device is a valve.

In an embodiment, the valve is configured to open when subjected to a pressure exceeding a pre-determined threshold pressure.

In an embodiment, the fluid chamber comprises a pressure compensation unit.

In an embodiment, the pressure compensation unit comprises a piston acting against a pre-loaded spring, a piston acting against a compressible gas, or a bladder.

In an embodiment, the plug further comprises a connector configured for engagement with an installation tool.

In an embodiment, the plug is a dummy plug for sealing an opening in a production tubing.

In an embodiment, there is provided a production tubing for a petroleum well, comprising a pipe, at least one side pocket mandrel, and at least one plug.

BRIEF DESCRIPTION OF THE DRAWINGS

Illustrative embodiments will now be described with reference to the appended figures, in which.

DETAILED DESCRIPTION OF THE INVENTION

Figure 1:
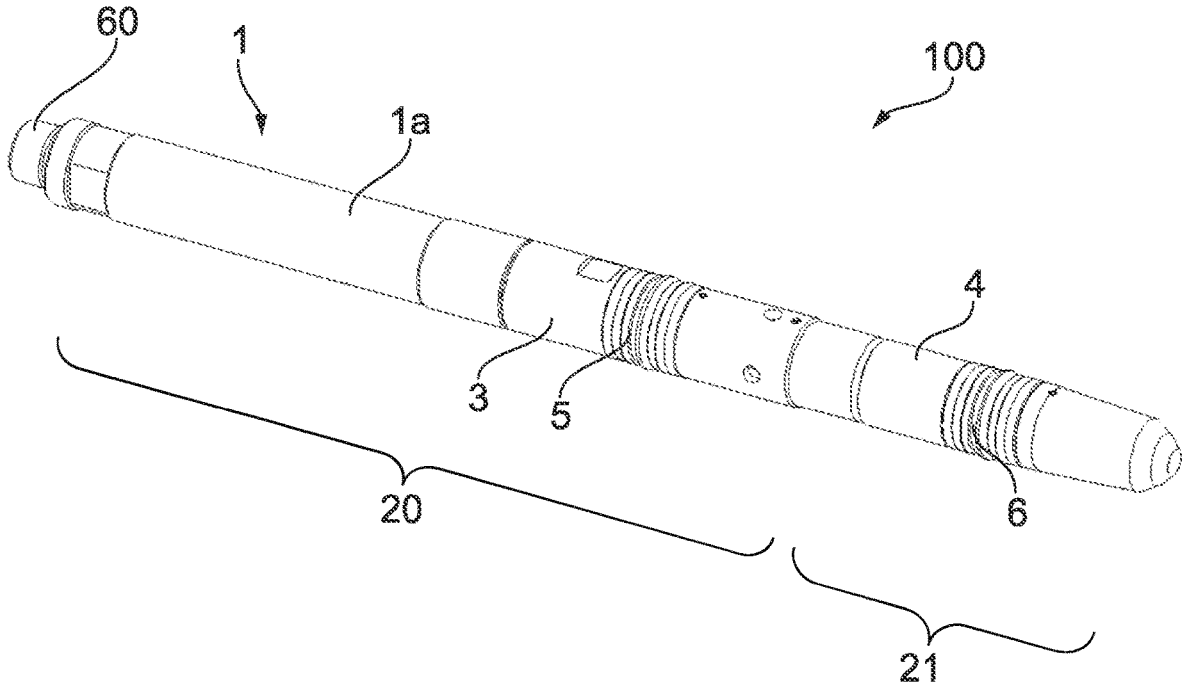
FIGS. 1 and 2 show illustrations of a plug according to an embodiment.
Figure 2:
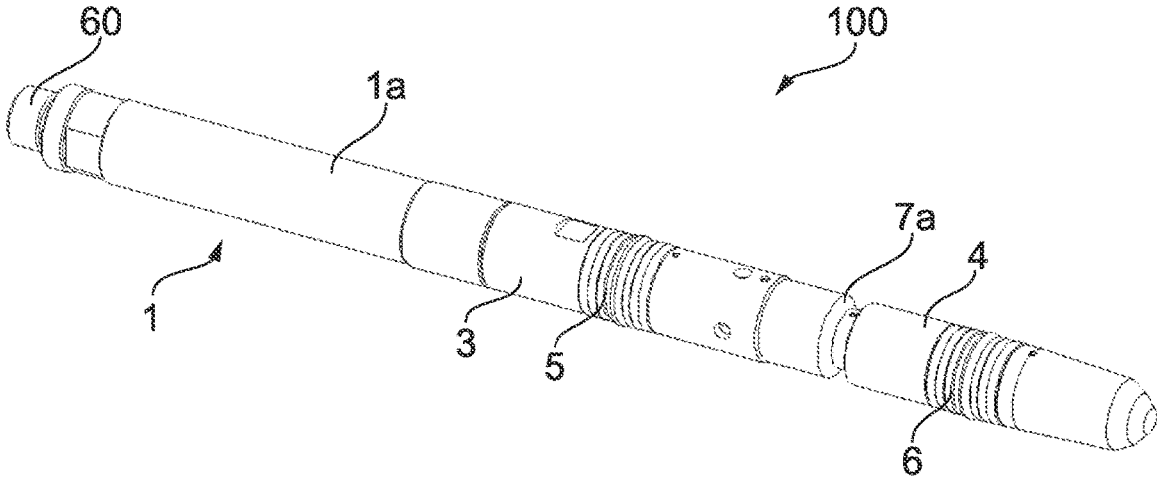

FIGS. 1 and 2 show a plug 100 for use in a wellbore during petroleum production. The plug 100 has an elongate body 1, a first seal 5 arranged on an outer surface 1*a* of the elongate body; and a second seal 6 arranged on the outer surface of the elongate body and spaced longitudinally from the first seal. The seals 5 and 6 may be O-rings.

The body 1 comprises a first part 3 and a second part 4, and the first seal 5 is arranged on the first part 3 and the second seal 6 is arranged on the second part 4. The first part 3 is coupled to the second part 4 and movable in relation to the second part 4 in the direction of the longitudinal axis of the body.

The first part 3 forms a back section 20 of the plug 100 and the second part 4 forms a front section 21 of the plug 100. The first part 3 and the second part 4 have substantially circular cross sections 3*a*,4*a* (illustrated in FIG. 5), and the cross section 4*a* of the second part 4 is smaller than the cross section 3*a* of the first part 3. The plug 100 may comprise a connector 60, configured to be engaged by an installation/intervention tool (not shown), for example a wireline tool for use in a subterranean well.

Figure 3:
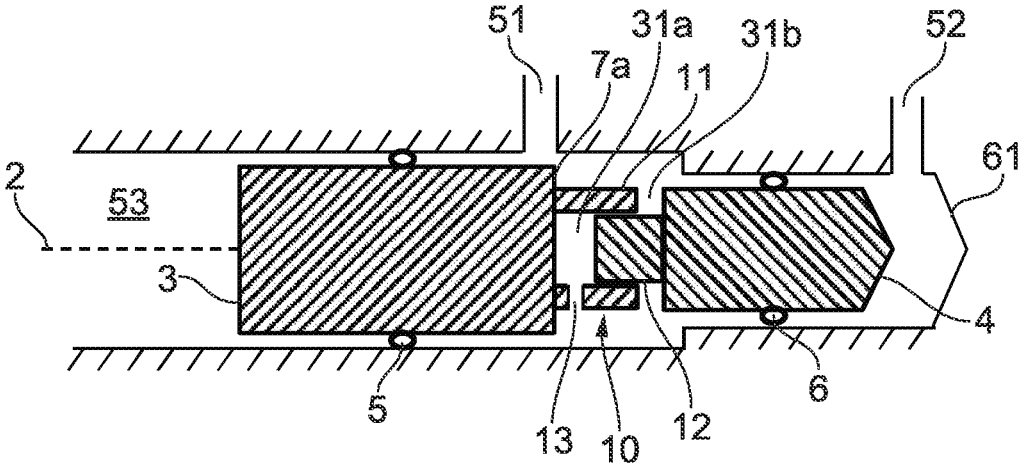
FIGS. 3-5 show schematic illustrations of aspects of the plug.
Figure 4:
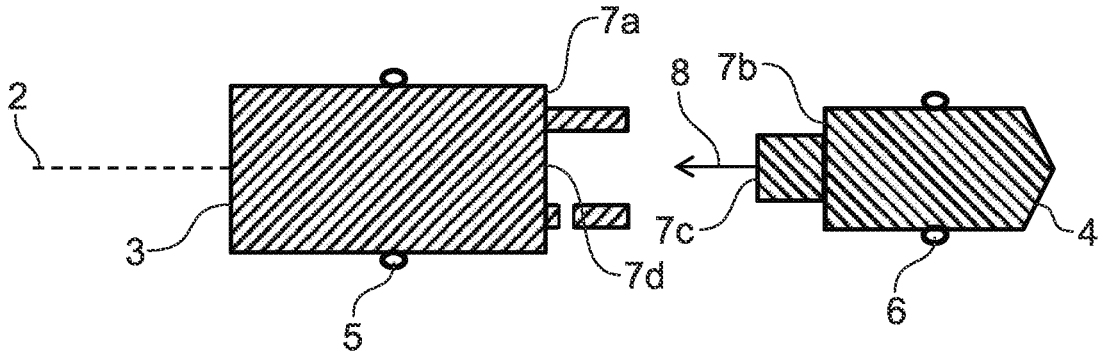
Figure 5:
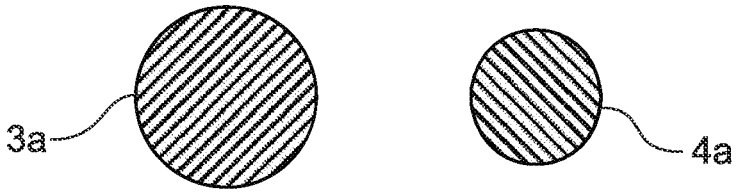

FIGS. 3-5 show, schematically, further details and aspects of the plug 100.

The first part 3 is coupled to the second part 4 by means of a telescopic connector 10. The telescopic connector 10 comprises a pin 12 fixed to the second part 4, the pin being slidably arranged in a receiver 11 fixed to the first part 3. Relative movement between the first part 3 and the second part 4 in the longitudinal direction 2 of the plug body is therefore made possible.

FIG. 3 shows the plug in use, installed in a side pocket mandrel (SPM) 61 of a production tubing for a petroleum well. The SPM 61 comprises slot 53 wherein a valve or a plug can be positioned, an inlet port 51, and an outlet port 52. The slot 53 is accessible from the production tubing bore, and the valve or plug can be installed by means of an installation tool, e.g. a wireline tool. The inlet port 51 is fluidly connected (directly or indirectly) with an annulus between the production tubing and a well casing. The outlet port 52 is fluidly connected (directly or indirectly) to the production tubing.

Depending on the operational requirements and the state of the well, a valve can be arranged in the slot 53. In the case of gas lift, pressurised gas can then be supplied to the inlet 51 and selectively led to the outlet 52 by the valve.

Alternatively, a dummy plug 100 can be arranged in the slot 53. The plug has the objective to seal between the inlet 51 and the outlet 52 in a reliable manner, for example when the well is producing sufficiently as a result of the existing reservoir pressure, and no gas lift is required.

A problem which may occur when using such plugs is that one in certain situations can experience an undesired pressure build-up between the seals 5 and 6. This may occur, for example, if the inlet 51 is closed upstream of the SPM, for example if the inlet 51 is connected to a second SPM which holds a plug or a closed valve. (This is common in configurations which are set up for using two or more gas lift valves in series.) In such a case, the inlet 51 and the volume between the seals 5 and 6, as soon as these seal against the walls of the SPM 61, may form a closed, liquid-filled volume. When installing the plug, this volume will be reduced as the plug is moved into the slot 53, and the trapped liquid may cause a significant pressure build-up, which may damage the seals 5 and 6. This may also cause so-called hydro-locking, i.e. prevent a correct installation of the plug in the slot. Further, when installed, the liquid trapped in this volume may be subjected to large temperature variations during the petroleum production processes. This may cause the trapped liquid to expand or contract, which may also cause excessive, and varying, pressure differentials across the seals 5 and 6.

When the plug 100 is exposed to a large pressure increase in the space between the seals 5 and 6, the first part 3 will be urged away from the second part 4. Since the first part 3 and second part 4 are movable relative to one another, this motion reduces the pressure of the trapped liquid, thereby ensuring that the seals 5 and 6 are not damaged. Similarly, if the pressure in the trapped volume is reduced, and the seals 5 and 6 is exposed to a large pressure differential in the opposite direction, the first part 3 and the second part 4 will move towards each other and thus reduce the load on the seals.

The first part 3 may have at least one surface 7*a*,7*d* on which this pressure acts, and which thereby aids the motion of the first part 3 relative to the second part 4. Similarly, the second part 4 may have at least one surface 7*b*,7*c* which aids the motion of the second part 4 relative to the first part 3. This is illustrated in FIG. 4, which shows an exploded view of the first part 3 and the second part 4.

The surfaces 7*a*,7*b*,7*c*,7*d* each have a normal vector 8 (illustrated only in relation to surface 7*c*). The normal vector need not be the same for all surfaces. The normal vector has an angle in relation to the longitudinal axis 2 which is different than 90 degrees. When subjected to a pressure from the fluid trapped between the seals 5 and 6, each surface thereby produces a pressure force which urges the first part 3 away from the second part 4. The normal vector does not need to be parallel to the longitudinal axis 2, it is sufficient that there is an angle such that a pressure force component in the direction of the longitudinal axis 2 is generated.

The pin 12 may comprise a surface 7*c* and the plug may further comprise a port 13 (see FIG. 3) arranged to provide fluid communication between the outside of the plug and the surface 7*c*. The port 13 may be arranged in the receiver 11.

Figure 6:
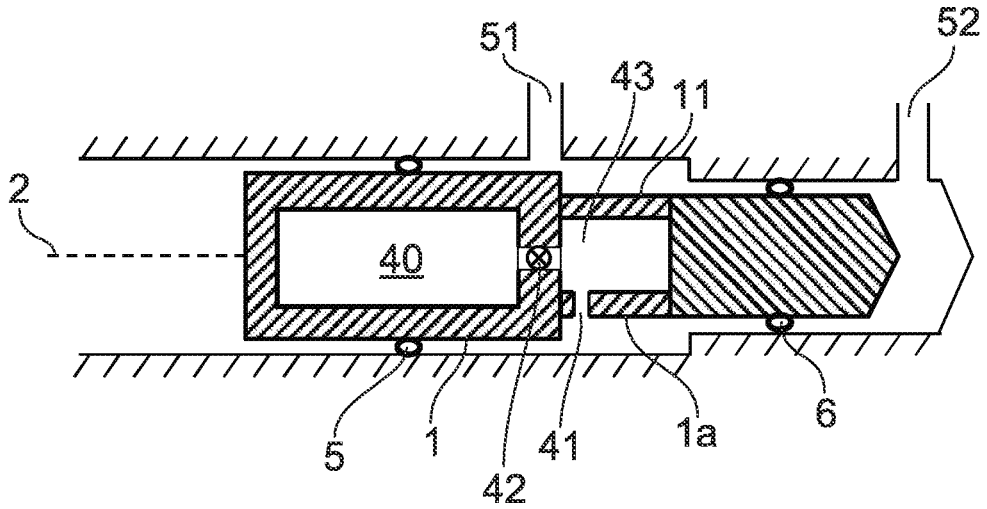
FIG. 6 shows a plug according to one embodiment.

FIG. 6 shows another embodiment according to the present invention. FIG. 6 shows a plug for use in a wellbore, having an elongate body 1 with a longitudinal axis 2. A first seal 5 is arranged on an outer surface 1*a* of the elongate body 1 and a second seal 6 is arranged on the outer surface of the elongate body 1 and spaced longitudinally from the first seal 5. A fluid chamber 40 is arranged in the body 1 and a fluid port 41 is arranged on the outer surface 1*a* of the elongate body between the first seal 5 and the second seal 6. A pressure control device 42 is arranged between the fluid port 41 and the fluid chamber 40, and configured to control the flow of fluid between the fluid port and the fluid chamber.

As described above, in certain situations there may be a pressure build-up between the first seal 5 and the second seal 6. In such a case, the pressure control device 42 may admit fluid into the fluid chamber 40, thereby reducing the pressure acting on the seals 5 and 6.

The pressure control device 42 may be a rupture disc, a piston, a piston held in place by a rupture pin, or any other element which is configured to break upon being subjected to a pressure exceeding a pre-determined threshold pressure.

The pressure control device 42 may, alternatively, be a valve. The valve may be pressure-controlled such as to open when subjected to a pressure exceeding a pre-determined threshold pressure.

Figure 7:
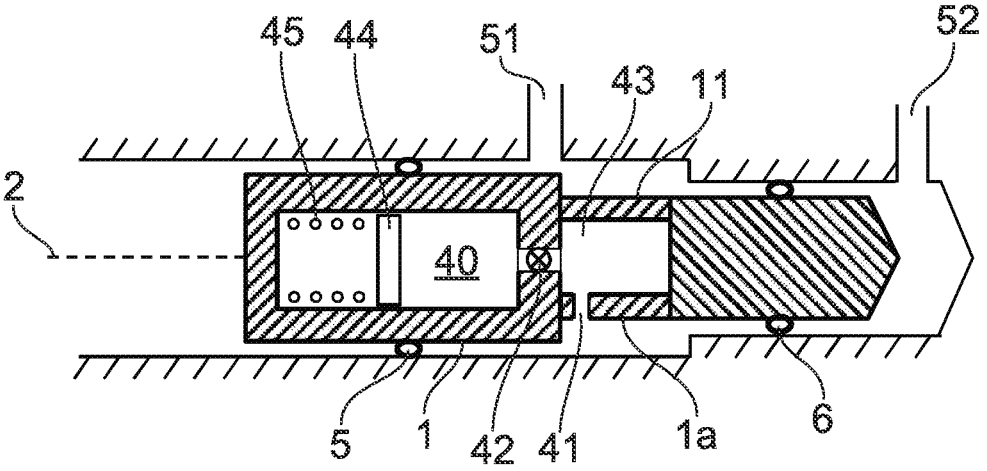
FIG. 7 shows a plug according to one embodiment.

The fluid chamber 40 may comprise a pressure compensation unit. This is illustrated in FIG. 7. In this examplatory embodiment, a spring-loaded piston 44 is used. The spring 45 is pre-tensioned such as to provide a desired piston force profile. The piston 44 is sealed against the side walls of the fluid chamber 40 and the spring loaded piston thus provides a controlled fluid pressure in the fluid chamber 40.

The pressure compensation unit may be of any suitable type, such as a piston acting against a pre-loaded spring, a piston acting against a compressible gas, a bladder accumulator, or an equivalent arrangement.

Figure 8:
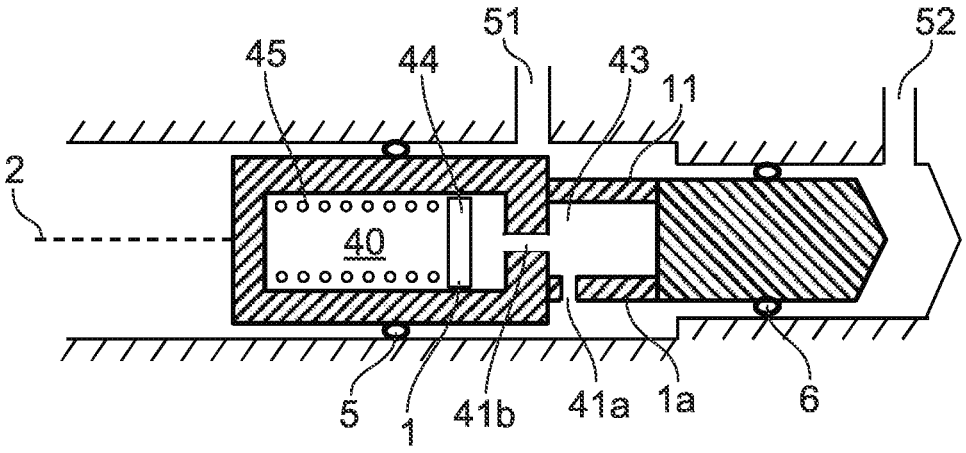
FIG. 8 shows a plug according to one embodiment.

FIG. 8 shows a further embodiment according to the present invention. FIG. 8 shows a plug for use in a wellbore, having an elongate body 1 with a longitudinal axis 2. A first seal 5 is arranged on an outer surface 1*a* of the elongate body 1 and a second seal 6 is arranged on the outer surface of the elongate body 1 and spaced longitudinally from the first seal 5. A fluid chamber 40 is arranged in the body 1 and fluid ports 41*a* and 41*b* are arranged between the fluid chamber 40 and the outer surface 1*a* of the elongate body at a position between the first seal 5 and the second seal 6. The fluid chamber 40 comprises a pressure compensation unit, equivalent to that described above in relation to FIG. 7. By means of the fluid communication provided by the ports 41*a* and 41*b*, the pressure compensation unit may compensate for any pressure variations between the seals 5 and 6, thereby protecting the seals from damage.

Figure 9:
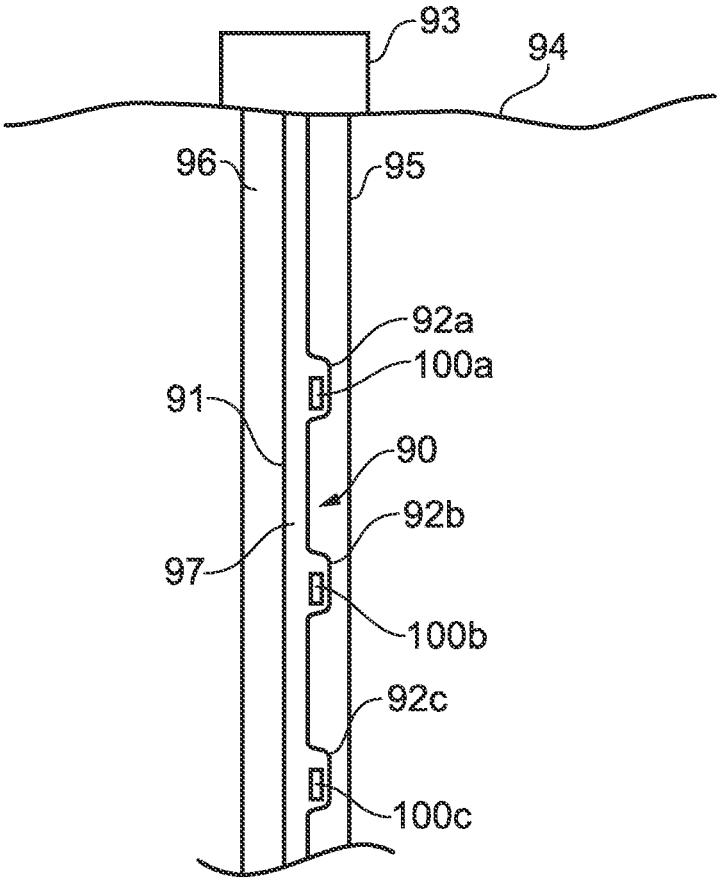
FIG. 9 shows a production tubing for a petroleum well.

In a further embodiment according to the invention, illustrated in FIG. 9, there is provided a production tubing 90 for a petroleum well. The production tubing 90 extends from a wellhead 93 located on a seabed 94. The wellhead 93 may also be located on a surface location, such as on land. A well casing 95 extends towards a subterranean reservoir (not shown). The production tubing 90 comprises a pipe 91 having at least one side pocket mandrel 92*a-c*. Each side pocket mandrel 92*a-c* has an opening which permits fluid communication between the inside 97 of the production tubing 90 and an annulus 96 between the well casing 95 and the production tubing 90. At least one plug 100, 100*a-c* according to any one of the embodiments described above is provided. Each plug may be arranged in a respective side pocket mandrel.

By providing a production tubing as illustrated in FIG. 9, the openings in the side pocket mandrels 92*a-c* can be securely sealed by means of the plugs 100*a-c*, such that there is no fluid communication between the annulus 96 and the inside 97 of the production tubing. For example, in the case of a well requiring gas lift, no such gas lift may be required for several years after the well start production, but may be required at a later stage when the reservoir pressure declines. By providing a plug and/or a production tubing according to embodiments of the invention, side pocket mandrels 92*a-c* can be securely and reliably sealed until gas lift is required. When gas lift is required, the plugs 100*a-c* can be replaced with valves such as to permit gas lift via the annulus 96. As an example, production tubing 90 for a petroleum well can include pipe 91, at least one side pocket mandrel 61, 92*a-c*, and at least one plug 100, 100*a-c*. The at least one plug can have an elongate body 1, the body having a longitudinal axis 2, a first seal 5 arranged on an outer surface 1*a* of the elongate body, a second seal 6 arranged on the outer surface of the elongate body and spaced longitudinally from the first seal, a fluid chamber 40 arranged in the body 1, and a fluid port 41 arranged on the outer surface 1*a* of the elongate body between the first seal 5 and the second seal 6.

The scope of the invention is not limited to the embodiments described herein; reference should be had to the appended claims.

What is claimed is:

1. A downhole plug, having:

an elongate body, the body having a longitudinal axis;

a first seal arranged on an outer surface of the elongate body; and a second seal arranged on the outer surface of the elongate body and spaced longitudinally from the first seal, wherein the body includes a first part and a second part, the first seal arranged on the first part and the second seal arranged on the second part, wherein the first part is coupled to the second part and is movable in relation to the second part in either direction along the longitudinal axis, wherein the plug is operable to continuously block flow between an inlet and an outlet during movement between the first part in relation to the second part in either direction along the longitudinal axis, and wherein the plug is operable to be used in a side pocket mandrel.

2. A plug according to claim 1, wherein at least one of the first part and the second part has a surface, each surface having a normal vector, the normal vector having an angle in relation to the longitudinal axis which is different than 90 degrees, and each surface arranged such that a pressure force acting on the surface urges the first part away from the second part.

3. A plug according to claim 1, wherein the first part is coupled to the second part by means of a telescopic connector.

4. A plug according to claim 3, wherein the telescopic connector includes a pin fixed to the second part, the pin being slidably arranged in a receiver fixed to the first part.

5. A plug according to claim 4, wherein the pin includes a front surface having a normal vector, the normal vector having an angle in relation to the longitudinal axis which is different than 90 degrees, and wherein the receiver includes a port arranged to provide fluid communication between the outside of the plug and the surface.

6. A plug according to claim 1, wherein the first part forms a back section of the plug and the second part forms a front section of the plug.

7. A plug according to claim 1, wherein the first part and the second part have substantially circular cross sections, and the cross section of the second part is smaller than the cross section of the first part.

8. A plug according to claim 1, wherein the plug further includes a connector configured for engagement with an installation tool.

9. A plug according to claim 1, where the plug is a dummy plug for sealing an opening in a production tubing.

10. A production tubing for a petroleum well, including:

a pipe, at least one side pocket mandrel, at least one plug, the at least one plug having:

an elongate body, the body having a longitudinal axis;

a first seal arranged on an outer surface of the elongate body; and a second seal arranged on the outer surface of the elongate body and spaced longitudinally from the first seal, wherein the body includes a first part and a second part, the first seal arranged on the first part and the second seal arranged on the second part, wherein the first part is coupled to the second part and is movable in relation to the second part in either direction along the longitudinal axis, and wherein the plug is operable to continuously block flow between an inlet of the side pocket mandrel and an outlet of the side pocket mandrel during movement of the first part in relation to the second part in either direction along the longitudinal axis.

* * * * *